US006082933A

United States Patent [19]

Maguire et al.

[11] Patent Number: 6,082,933

[45] Date of Patent: Jul. 4, 2000

[54] CONCRETE BLOCK

[75] Inventors: William H. Maguire, West Bay Shore; Robert L. Nicolia, West Islip; Vito Picone, Commack, all of N.Y.

[73] Assignee: Nicolock of Long Island, Lindenhurst, N.Y.

[21] Appl. No.: 09/093,597

[22] Filed: Jun. 9, 1998

[51] Int. Cl.[7] ..... E02D 5/00; E02D 17/00; E04B 2/08

[52] U.S. Cl. ..... 405/286; 52/592.6

[58] Field of Search ..... 405/284, 286; 52/592.6, 603–605, 608

[56] References Cited

U.S. PATENT DOCUMENTS

| | | | |
|---|---|---|---|
| 4,964,761 | 10/1990 | Rossi | 405/286 |
| 5,622,456 | 4/1997 | Risi et al. | 405/284 |
| 5,647,185 | 7/1997 | Forlini | 52/604 |
| 5,711,130 | 1/1998 | Shatley | 52/604 |
| 5,800,097 | 9/1998 | Martin | 405/284 |
| 5,816,749 | 10/1998 | Bailey, II | 405/286 |
| 5,827,015 | 10/1998 | Woolford et al. | 405/286 |
| 5,865,006 | 2/1999 | Dawson | 52/604 |
| 5,894,702 | 4/1999 | Stenekes | 52/604 X |
| 5,951,210 | 9/1999 | Maguire et al. | 405/286 |

*Primary Examiner*—Eileen Dunn Lillis
*Assistant Examiner*—Tara L. Mayo
*Attorney, Agent, or Firm*—Bauer & Schaffer, LLP

[57] ABSTRACT

Shaped concrete blocks are provided each having generally parallel top and bottom surfaces, a shaped front face (adapted to be exposed as the wall element), side walls and a rear wall. The one surface of each block is provided with transverse shallow groove, while the other surface of each block is provided with a conforming rib positioned correspondingly with the grooves. In this manner, successive blocks may be stacked on top of one another with the ribs engaging in the grooves.

11 Claims, 2 Drawing Sheets

CONCRETE BLOCK

BACKGROUND OF THE INVENTION

The present invention relates to a shaped concrete block and in particular an interlocking concrete block used for the construction of a retaining wall.

Retaining walls are necessary to secure soil embankments adjacent roadways, rail lines, parking areas, etc. from sliding or giving way as a result of loading, underground pressures, weathering due to rain and other shifts in terrain. A retaining wall must withstand horizontal pressures from the retained soil behind the wall which could cause the wall to give way.

Traditionally, such walls have been constructed from concrete, bricks, wood ties and other similar materials piled or erected to form a wall behind which earth is back filled. With the ability to mold and cast concrete blocks rather inexpensively, improved retaining walls have been designed by stacking concrete blocks.

One known type of concrete block is provided with a hole which allows a pin to be driven through it into corresponding holes in the blocks of the underlying courses. In addition to the significant on-site labor requiring careful alignment of the blocks, the pins afford limited vertical stability, resulting in a wall having reduced strength. Grids have been used in conjunction with the blocks to add strength to such walls. These grids are placed over the pins, between the blocks, and laid out into the back fill. However, the grids offer little additional strength as the pins shear the grids over time causing the grid material to fail.

In my co-pending application Ser. No. 08/820,443, filed Mar. 12, 1997, now U.S. Pat. No. 5,951,210, an improved pinless, mortarless, interlocking block is shown. However, the need still exists for an interlocking block which can withstand a great horizontal force from behind the wall.

Furthermore, due to the significant weight of concrete blocks, a need exists for a block which can be lifted more easily, and placed in position without pinching the installer's fingers.

It is an object of the present invention to provide an interlocking concrete block for constructing retaining walls which can withstand a great horizontal force acting from behind the wall.

It is a further object of the present invention to provide a concrete block which is easier to handle such that the block can be lifted more easily and placed in position without pinching the installer's fingers.

It is a further object of the present invention to provide a concrete block which can be stacked securely in a variety of configurations.

SUMMARY OF THE INVENTION

The present invention enables the construction of retaining walls by providing a block, preferably formed of concrete, of rectilinear shape. The top wall of the block is provided with a groove situated a predefined distance from the front wall. The bottom wall is provided with a rib, conforming in cross section to that of the groove. The rib is placed a distance greater than the predefined distance of the rib from the front wall. Thus, when stacked, the blocks can be offset.

The block is also provided with a second rib adjacent the back wall which will overhang the rear wall of the block in the course below. The upper edge of the top wall is chamfered to accommodate the overhanging rib.

Full details of the present invention are set forth in the following description and illustrated in the accompanying drawings.

DESCRIPTION OF THE INVENTION

Figure 3:
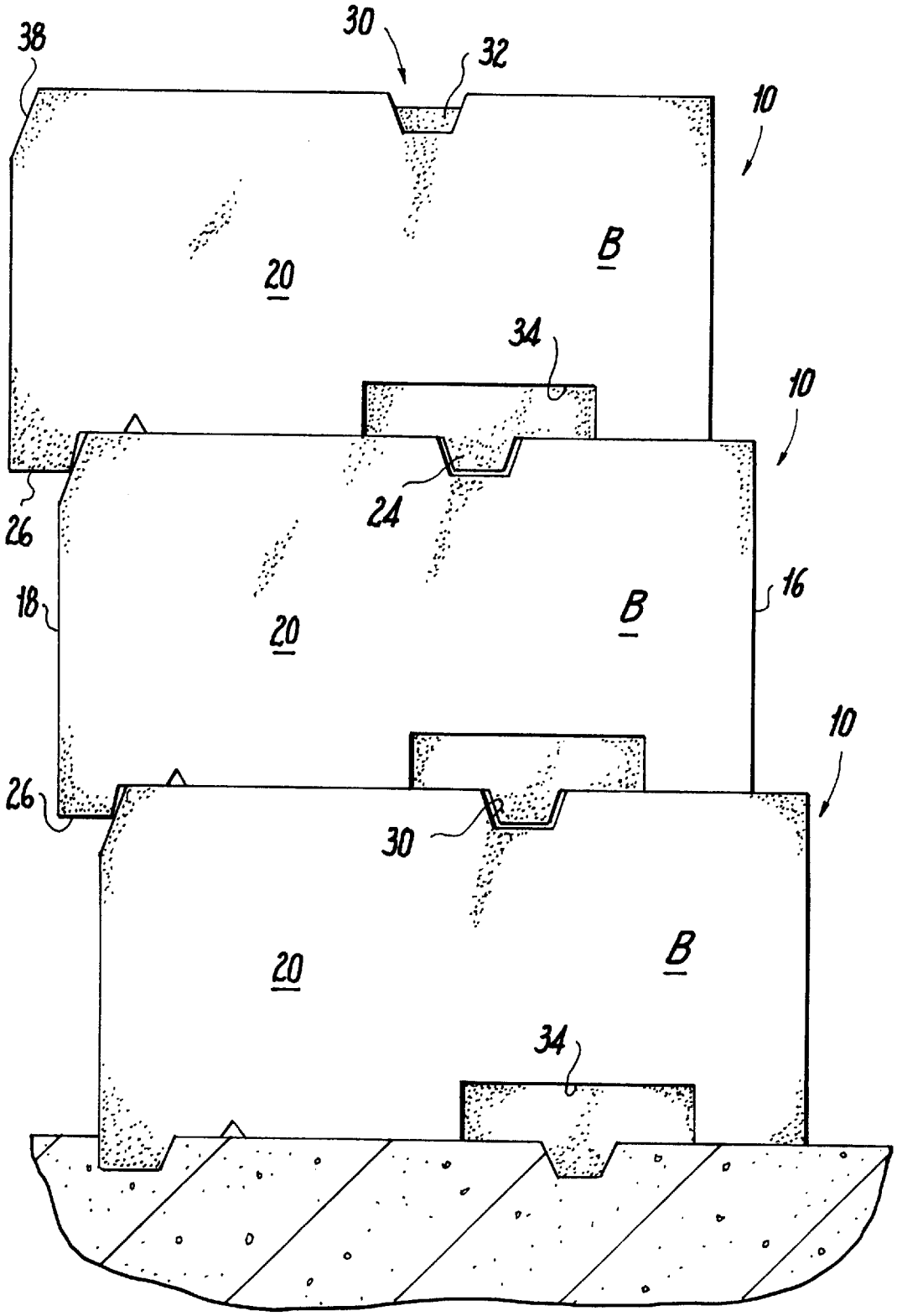
FIG. 3 is a side view showing a plurality of blocks forming a retaining wall.

Before turning to a description of the block of the present invention, reference is made to FIG. 3, wherein a retaining wall, generally depicted by the letter W, is shown constructed of a plurality of courses of blocks B, each formed in accordance with the present invention.

Figure 1:
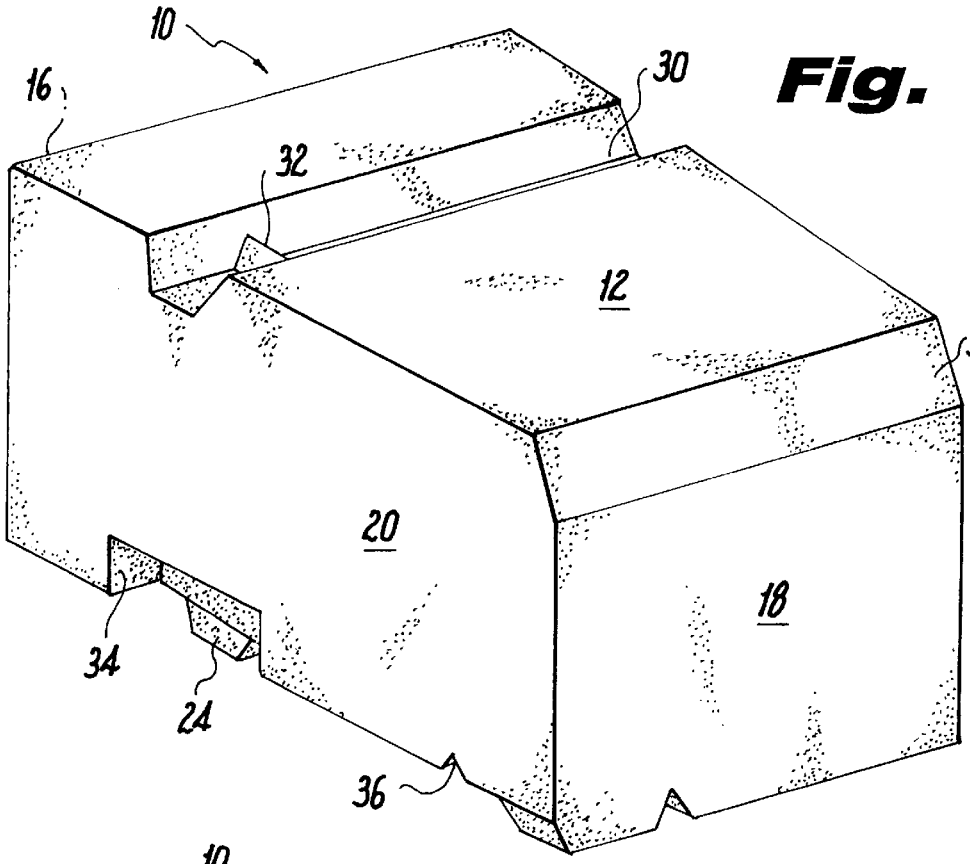
FIG. 1 is a top perspective view of the block according to the present invention.
Figure 2:
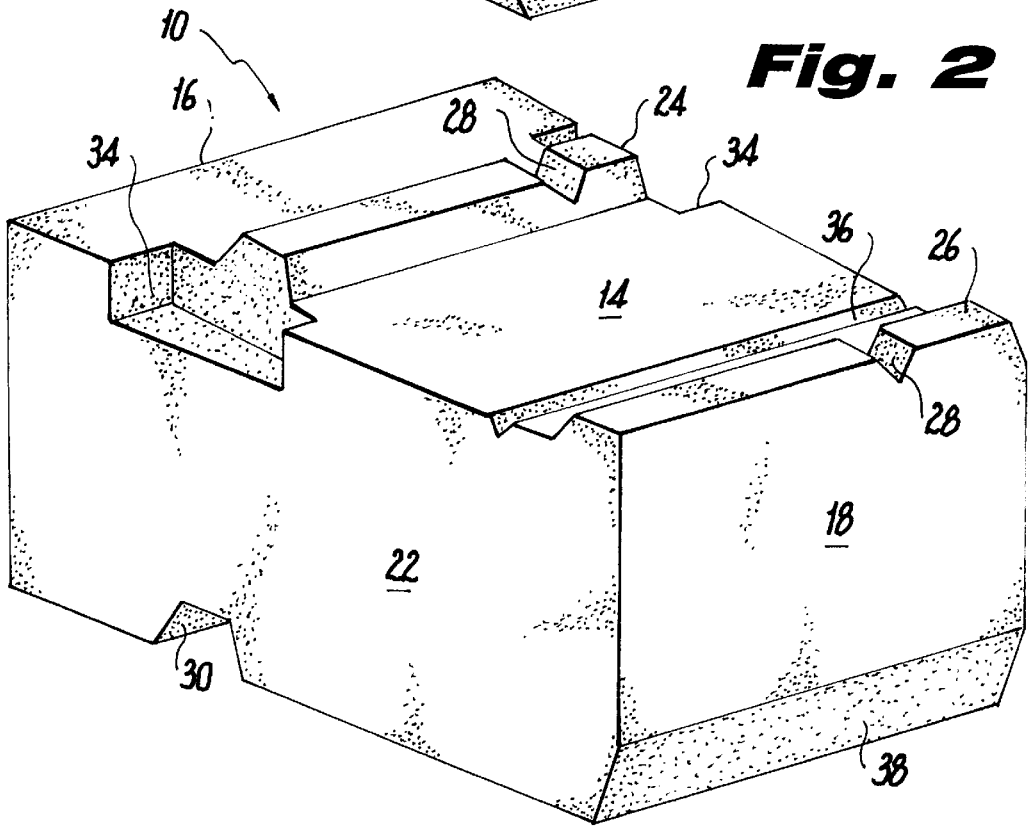
FIG. 2 is a bottom perspective view of the block of FIG. 1.

As seen in FIGS. 1 and 2, as well as FIG. 3, the individual blocks, each generally depicted by the numeral 10, comprise an integrally formed body having an overall rectilinear shape of uniform thickness from top to bottom. Each block 10 has top and bottom walls 12 and 14 respectively, front and back walls 16 and 18 respectively, and first and second side walls 20 and 22 respectively, opposite each other. Each of the opposing walls are generally planar and parallel to each other.

The bottom wall 14 is provided with projecting ribs 24 and 26. Rib 26 is adjacent the back face 18. Rib 24 is spaced from rib 26 close but not adjacent to the front face 16. The distance between the ribs 24 and 26 is preferably greater than the distance between rib 24 and the front wall 16.

The ribs 24 and 26 are trapezoidal, being wider at their base than at their peak and at least the front surface of each rib is tapered. Each rib 24 and 26 is divided by a V-shaped groove 28 located closer to the side wall 20 than to the opposite side wall 22. The grooves 28 lie along a line parallel to the side walls. The longer portion of each rib is preferable twice the length of the smaller portion.

The top wall 12 of each block is provided with a trapezoidal groove 30 which conforms in cross-sectional shape to that of the rib 24 on the bottom wall 14. The groove 30 transversely extends across the back from side to side. At the bottom of the groove 30, there is provided a nub 32, adapted to fit with the V-shaped groove 28 formed in the rib 24. The interlocking of the stacked blocks is thus assured and sideways movement is prevented.

Cut into the corner edge of the opposite wall 22 and the bottom wall 14, in line with the front rib 24, is a recess 34 which provides a handhold for manually handling the block 10. A second similarly formed handhold 34 is fashioned on the other end of rib 24. As a result, the block can be held on both sides, and although quite heavy, can be conveniently manipulate by ease of the handholds 34, which allow the block to be grasped in more or less balance. As seen in FIG. 3, the handholds enable the precise installation in stacked position without fear of pinching the finger between the blocks.

The blocks are made of molded concrete, concrete aggregate or similar material, in a conventional manner known in the art. The front wall 16, i.e. the face exposed to view when the retaining wall is constructed, can be provided with decorative embossment, inserts or facial designs to enhance the appearance of the wall. The side walls 20 and 22 may also be slanted or tapered from front to rear so that adjacent blocks, in the same course, can be abutted thereby unabling the formation of a curved wall.

Lastly, the bottom wall 14 of the block is provided with a small transverse groove 36, adapted to receive a binding strap (not shown). In this manner, a plural number of blocks can be assembled and secured for shipment and/or storage.

As seen in FIG. 3, the groove 30 is set back from the front wall 16, a greater distance than is the rib 24, so that when the blocks 10 are stacked one on top of the other, the blocks are offset front to rear. The rear corner edge 38 is chamfered so that the rear rib 26 will engagingly fit over the chamfered edge 38 locking the block rear to front in offset condition when stacked.

As shown in FIG. 3, an interlocked retaining wall is formed by stacking successive blocks 10 one on top of another such that the rib 24 of the upper block 10 engages within the groove 30. The lowermost block can be set directly on the ground since the ribs on the bottom wall will act as cleats anchoring the block in the soil. Due to the offset position of the ribs 24 and 26, the retaining wall will take on a predetermined incline. The amount of the offset will determine the degree of the incline. The incline adds to the ability of the wall to resist horizontal forces from behind the wall. The rib 26, being conformingly slanted to the chamfer 38, overhangs the lower block 10 such that the front end of the rib securely engages the rear wall of the block 10 below it.

A coping block (not shown) may be provided. The coping unit will have a smooth upper surface but a bottom provided with a rib conforming to rib 24 so that it may be placed over the last course and held against movement.

It is also seen that the present invention provides an improved, inexpensive concrete block which can be manually handled.

Various modifications and changes have been disclosed herein and others will be apparent to those skilled in the art. Therefore, it is to be understood that the present disclosure is by way of illustrating and not limiting the present invention.

What is claimed is:

1. A block for erecting a retaining wall having multiple courses of blocks, each block comprising a body having front and rear walls, top and bottom walls, and interconnecting side walls, the top wall each of said block being provided with a transverse groove offset from the front wall, the bottom wall of said block being provided with transverse first and second downwardly projecting ribs, said first rib having a cross-sectional shape similar to that of the groove and adapted to seat within said groove when the block is stacked on a block of the next lower course, said first rib being offset from the front wall of said block a distance less than the offset of said groove from said front wall said second rib projecting from said bottom wall along said rear wall so that when the blocks are stacked the first rib seats within said groove and the second rib overhangs and engages the rear wall of the lower block, whereby the blocks are interlocked in successive inclined courses.

2. The block according to claim 1, wherein said first and second ribs have a trapezoidal cross section.

3. The block according to claim 1, wherein at least one of said side walls is tapered from front to rear so that the rear wall is smaller width wise than said front wall.

4. The block according to claim 1, wherein the rear wall includes a chamfer along its edge with the top wall.

5. The block according to claim 4, wherein said second rib and said chamfer have slanted conformingly engaging edges.

6. The block according to claim 1, wherein the corner edge of the bottom wall and each of said side walls are formed with a recess allowing the user to hold said block.

7. The block according to claim 6, wherein said recess is aligned with said first rib.

8. The block according to claim 1, wherein the bottom wall is grooved to provide a seat for a binding strap.

9. A retaining wall comprising successive courses of blocks stacked one course on top of another, each of said blocks being formed according to any one of claims 1–8.

10. The block according to claim 1, wherein said first rib has a notch dividing said first rib into first and second portions, and said groove is provided with a nub having a location and a shape adapted for fitting into said notch of a block stacked above for preventing sidewards movement of said block relative to the block stacked above.

11. The block according to claim 10, wherein said first rib portion has a length double the length of said second portion.

* * * * *